United States Patent [19]

Moyaux et al.

[11] 4,157,817

[45] Jun. 12, 1979

[54] CONVERTER

[75] Inventors: Alain G. Moyaux; Gilbert J. Amann, both of Trith St Leger; Amédée Lebrun, Maing; Michel Poupon, Trith St Leger; Gérard Gorgeret, Mont St Martin, all of France

[73] Assignee: Union Siderurgique du Nord et de l'est de la France, Paris, France

[21] Appl. No.: 843,256

[22] Filed: Oct. 18, 1977

[30] Foreign Application Priority Data

Oct. 19, 1976 [FR] France ..... 76 31412
Sep. 14, 1977 [FR] France ..... 77 27781

[51] Int. Cl.[2] ..... C21C 5/48
[52] U.S. Cl. ..... 266/222; 266/268
[58] Field of Search ..... 75/51, 52, 59, 60; 266/218, 220–224, 243–247, 265–270; 302/28

[56] References Cited

U.S. PATENT DOCUMENTS

| | | | |
|---|---|---|---|
| 3,591,160 | 7/1971 | Leroy | 266/223 |
| 3,633,898 | 1/1972 | Josefsson et al. | 266/220 |
| 3,774,894 | 11/1973 | Knuppel et al. | 266/222 |
| 3,796,420 | 3/1974 | Pearce | 266/224 |
| 3,868,096 | 2/1975 | Schempp | 266/222 |
| 3,873,074 | 3/1975 | Chang | 266/241 |
| 4,027,920 | 6/1977 | Wennerstrom | 302/28 |
| 4,062,530 | 12/1977 | Griffiths | 266/222 |

FOREIGN PATENT DOCUMENTS

| | | | |
|---|---|---|---|
| 544393 | 2/1932 | Fed. Rep. of Germany | 266/267 |

*Primary Examiner*—Gerald A. Dost
*Attorney, Agent, or Firm*—Burns, Doane, Swecker & Mathis

[57] ABSTRACT

A device comprises tuyeres at the bottom of the converter and a cylindrical manifold for fluids and powdered products disposed in the center part of and under the bottom of the converter. Connecting pipes between the manifold and the tuyeres are disposed radially around the manifold. The connecting pipes have the shape of a lyre with a closed loop.

12 Claims, 7 Drawing Figures

FIG. 1
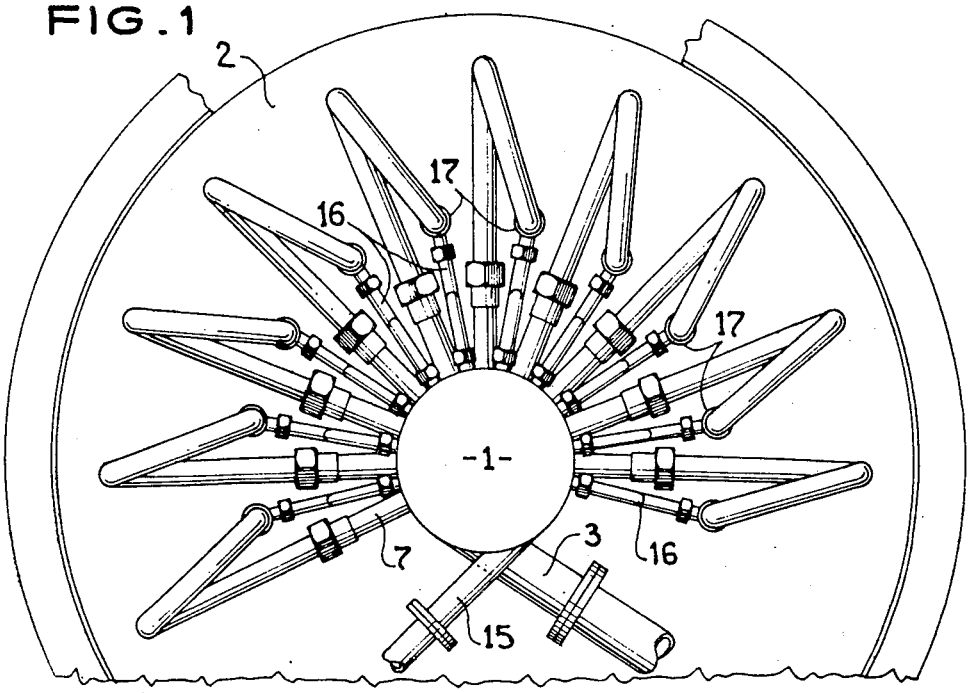
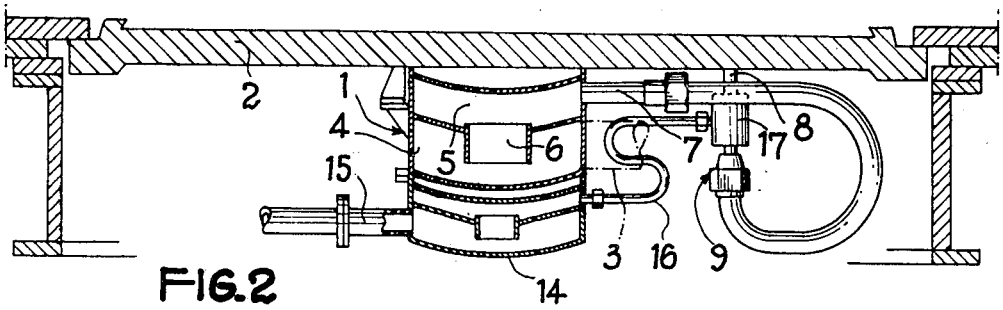
FIG. 2
FIG. 3
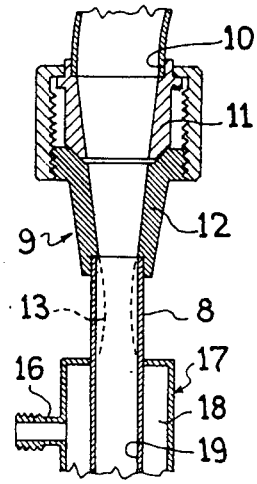

CONVERTER

The present invention relates to a device for introducing fluid and powdered products in the tuyeres of the bottom of a converter.

The steel in the converter is refined by an intense blast through the bottom of the converter of a fluid such as air or pure oxygen, possibly containing powdered materials such as powdered lime.

The fluid containing a powdered material was injected up to the present time by means of a device comprising a circular conduit located at the base of the converter and, leading from this circular conduit, connecting pipes disposed at even distances on the circular conduit to connect the latter to each one of the tuyeres arranged on the bottom of the converter. The fluid and powdered products are supplied to the circular conduit usually by a conduit which opens out at a point of the circular conduit and the connecting conduits have an S shape for compensating for expansion.

However, the distribution of the fluid and powdered products achieved by such a device is not uniform in the circuit and, moreover, there is an intense abrasion of the inlet of the tuyeres which requires the use of ceramic protecting tubes which must be changed frequently.

An object of the present invention is to overcome these drawbacks and to provide a device whereby it is possible to achieve an even distribution of the fluid and powdered products in the circuit while reducing the abrasion at the inlet of the tuyeres so that it is possible to dispense with the costly utilization of protecting tubes, the device moreover having a reduced overall size so that the number of tuyeres may be increased if desired.

According to the invention, there is provided a device for injecting fluid and powdered products by way of the tuyeres of a bottom of a converter, of the type comprising a cylindrical manifold for fluids and powdered products located in a centre part under the bottom of the converter and connecting pipes between the manifold and the tuyeres disposed radially around the manifold, wherein the connecting pipes have the shape of a lyre with a closd loop.

According to another feature of the invention, the cylindrical manifold has two stages which communicate with each other by way of a centre cylindrical neck, the connecting pipes being disposed radially at the base of the manifold and the fluid and powdered products being supplied in a tangential direction by way of a supply conduit opening out in the upper stage.

According to a further feature of the invention, the inside diameter of the connecting pipes is greater than the inside diameter of the tuyeres, the reduction in section occurring in a part-conical connector.

According to another feature of the invention, rectilinear portions of the connecting pipes between the manifold and the tuyeres have unequal lengths.

According to yet another feature of the invention, the converter comprises a cylindrical manifold for a fluid for cooling the nose of the tuyeres, the connecting pipes connected to the tuyeres being in the shape of an S or an extended lyre having an open loop.

Further features and advantages of the invention will be apparent from the ensuing description with reference to the accompanying drawings, in which:

FIG. 1 is a plan view of a device for injecting fluid and powdered products placed on the bottom of the converter.

FIG. 2 is a partial sectional view of the device shown in FIG. 1;

FIG. 3 is a sectional view of a part-conical connector between a connecting pipe and a tuyere and the inlet of the tuyere;

Figure 4:
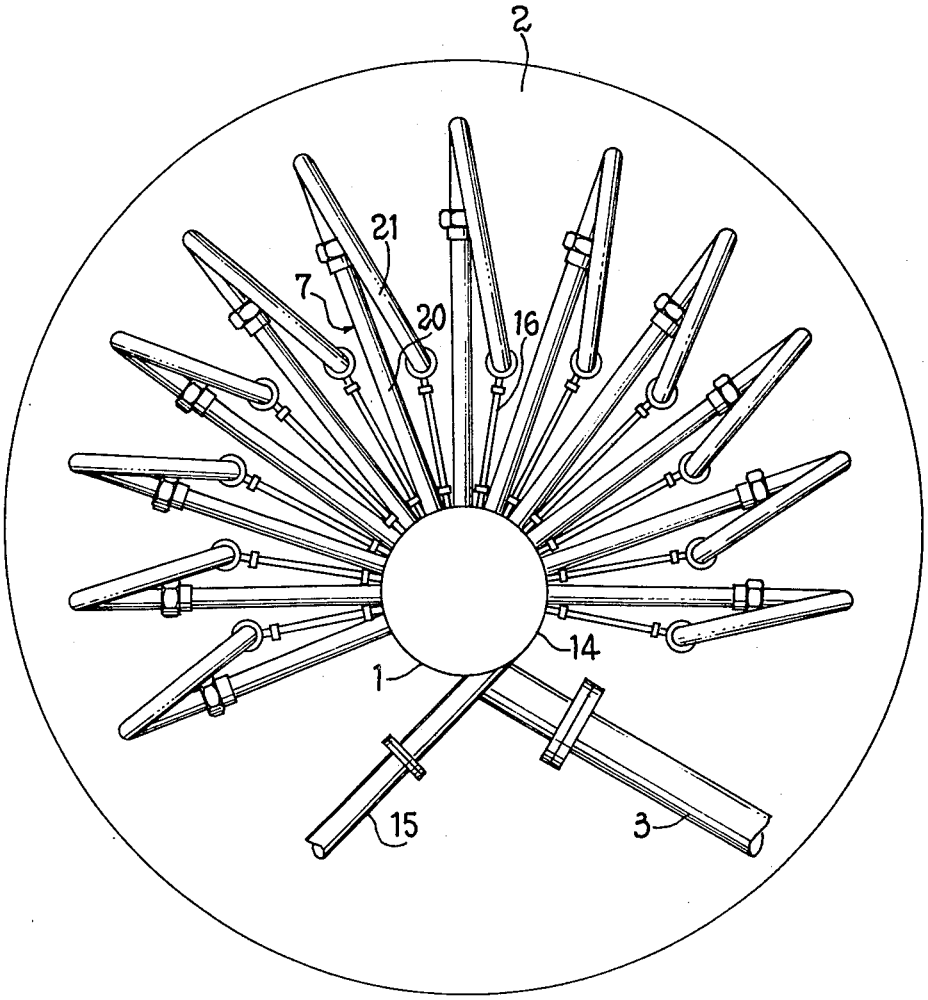
FIGS. 4, 5 and 7 are plan views of three other embodiments of the device according to the invention.

Although the device according to the invention may be used for the injection of any powdered products carried along by any liquid or gaseous fluids, the following description will be made with reference to a stream of pure oxygen containing particles of lime having a particle size of about 40 to 100 mμ.

The lime is present in the oxygen in a proportion of about 3 to 8 kg/m$^3$ of $O_2$ and the total flow of oxygen is about 15000 m$^3$/hour.

In FIGS. 1 and 2, a manifold 1 having two stages placed at the centre of the bottom 2 of a converter receives a stream of oxygen containing powdered lime tangentially through a supply conduit 3. The conduit 3 extends into the manifold 1 in the lower stage 4, the lower stage 4 and the upper stage 5 of the manifold communicating with each other by way of a centre neck 6 of cylindrical shape. The conduit 3 leads from a rotatable connector (not shown) mounted on one of the trunnions of the converter and supplied with oxygen and powdered lime by way of the centre of the trunnion.

Connecting pipes 7 extend out of the upper stage 5 of the manifold and connect the latter to the tuyeres 8 which are disposed in an arc of a circle on the bottom of the converter. The pipes 7, which are ten in number in the illustrated embodiment, have the axis of the portion thereof extending from the manifold perpendicular to the axis of the cylinder which constitutes the manifold and the pipes 7 are in the general shape of an extended lyre having a closed loop and extend to the inlet of the tuyeres. This arrangement of the connecting pipes in the form of a loop rendered oval permits a laminar flow of the stream of oxygen containing the lime powder escaping from the manifold.

The inside diameter of the pipes 7 exceeds the inside diameter of the tuyeres 8 and the reduction in the sections is achieved in a part-conical connector 9 shown in FIG. 3.

In this connector 9, the outlet end 10 of the corresponding connecting pipe is welded to a connecting member 11 which has a part-conical inside shape and is connected to the inlet member 12 of the tuyere 8.

The gaseous stream of oxygen containing the lime powder issuing from the end 10 of the connecting pipes maintains through the connector 9 a laminar flow which permits detaching the gaseous stream 13, shown in dotted line, from the wall of the inlet part of the tuyere 8. This detachment of the gaseous stream decreases the abrasion of the tuyere by the lime particles and thereby enables the protecting tubes, which were heretofore necessary to operation of the converter, to be dispensed with.

Further, in order to cool the nose of the tuyeres in the course of the combustion stage, a liquid or gaseous hydrocarbon is sent around the tuyere at a point located downstream of the connector 9 and just before the penetration through the bottom plate of the converter.

In the case of a gaseous hydrocarbon which may be, for example, butane, its endothermal cracking when it arrives at the outlet end of the tuyere in the iron, produces the desired cooling effect. The hydrocarbon is supplied in proportion to the oxygen flow.

For introducing the hydrocarbon, there is provided a cylindrical manifold 14 which is similar to the manifold 1 and disposed below the latter, as shown in FIG. 2. The hydrocarbon enters in a tangential direction by way of a conduit 15 in the upper stage of the manifold 14 which communicates with a base stage.

Extending in a radial direction from the base stage of the manifold 14 are connecting pipes 16 in the shape of an S. The pipes 16 are connected to the tuyere by a T-coupling 17 which defines an annular space 18 in which the hydrocarbon circulates.

In FIG. 4 a manifold 1 for fluid and powdered products having two stages placed under the bottom 2 of a converter in a central position but slightly offset with respect to the centre of the bottom, receives tangentially, by way of a supply conduit 3, a stream of oxygen containing lime powder. Placed under the manifold 1 is another manifold 14 for a fluid for cooling the tuyeres and which receives tangentially, by way of the conduit 15, a stream of hydrocarbon, the conduits 3 and 15 being substantially orthogonal.

Connecting pipes 7 extend from the base stage of the manifold 1 and connect the latter to the tuyeres 8 placed at the bottom of the converter.

The tuyeres 8 are disposed on the bottom of the converter in accordance with a flattened contour substantially centered on the centre of the bottom of the converter. In the embodiment shown in FIG. 4, this contour is of trapezoidal shape two sides of which are curvilinear and the tuyeres are disposed on three of these sides.

Figure 6:
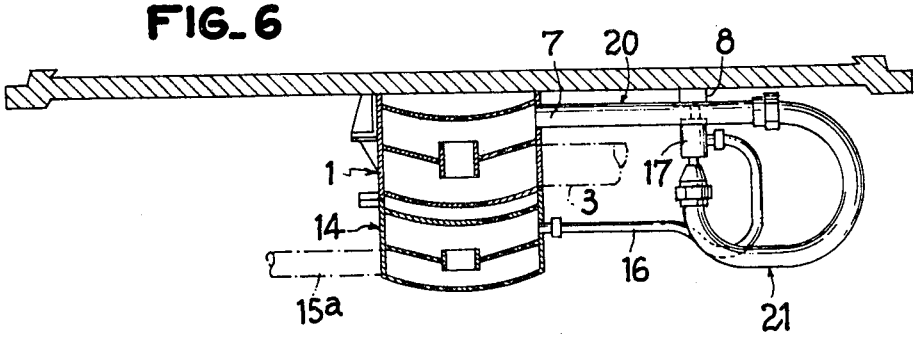
FIG. 6 is a partial sectional view of the device shown in FIG. 5.

In order to achieve this arrangement of the tuyeres, the rectilinear portions 20 and 21 of the pipes 7, which are more clearly visible in FIG. 6, are respectively of lengths which vary from pipe 7 to pipe 7'.

The pipes 16 connect the manifold 13 for the cooling fluid to the tuyeres 8 by way of a T-coupling 17. These pipes have the shape of an S and are interposed between the pipes 7.

Figure 5:
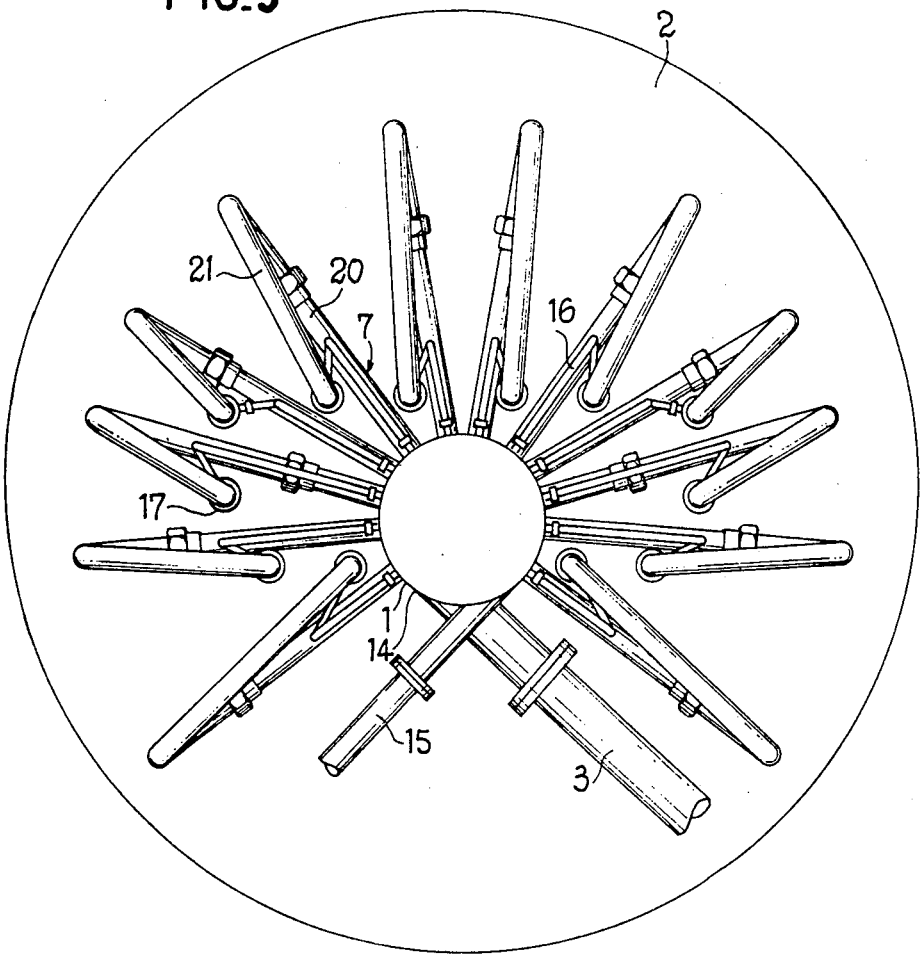

The embodiment of the injecting device shown in FIG. 5 is identical to the preceding embodiment in that it comprises manifolds 1 and 14 which are slightly offset with respect to the centre of the bottom of the converter, substantially orthogonal supply conduits 3 and 15 and connecting pipes 7 the portions 21 of which have unequal lengths.

The tuyeres are disposed in this embodiment in accordance with a contour of trapezoidal shape two of the sides of which are curvilinear, but the tuyeres are placed on all the sides of the trapezium which is substantially centered on the bottom of the converter.

Another feature of this embodiment resides in the connecting pipes 16 for connecting the manifold 14 of cooling fluid to the tuyeres shown in FIG. 6. These pipes extend radially from the manifold 14 but have the general shape of an extended lyre having an open loop and are disposed substantially on the same longitudinal axis as the portions 20 of the pipes 7.

Figure 7:
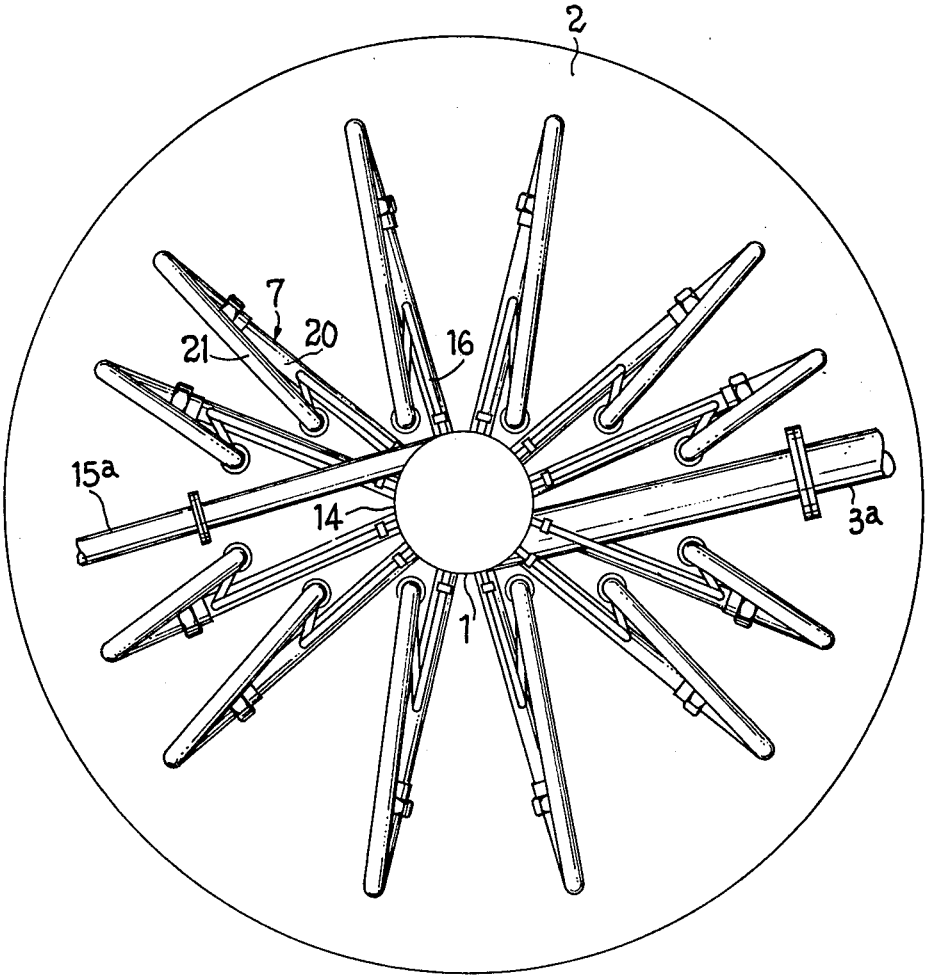

The embodiment shown in FIG. 7 comprises manifolds 1 and 14 located at the centre of the bottom of the converter, supply conduits $3^a$ and $15^a$ which lead to the manifolds in a tangential direction but which are parallel and disposed symmetrically with respect to the centre of the manifold.

In this embodiment, the connecting pipes 16 for the fluid cooling the tuyeres are identical to those of the embodiment shown in FIGS. 5 and 6, that is to say have the general shape of an extended lyre having an opened loop and are disposed substantially along the same longitudinal axis as the portions 20 of the pipes 7 and below the latter.

In this embodiment, the tuyeres are arranged evenly spaced apart on a very flattened ellipse centered on the centre of the bottom of the converter. To achieve this arrangement of the tuyeres, the rectilinear portions 20 and 21 of the pipes 7 are respectively of lengths which vary from pipe to pipe.

Thus, in the device for injecting oxygen and lime powder according to the present invention, the cylindrical manifold 1 operates as a kind of buffer tank which evenly distributes the oxygen and the lime powder in the connecting pipes having the shape of a lyre and a closed loop, whence the gaseous stream assumes a laminar flow pattern which it maintains in passing through the part-conical connector by becoming detached from the walls at the inlet of the tuyere. By means of this device there is consequently obtained both an even distribution of the lime powder in the circuit and a reduction in the abrasion phenomenon at the inlet of the tuyeres which enables dispensing with the expensive protecting tubes the replacement of which was relatively frequent.

Thus, according to other embodiments of the device for injecting oxygen and lime powder of the present invention, the tuyeres are arranged at the bottom of the converter in a zone which is more central and has a smaller area and is more symmetrical with respect to the centre of the bottom, which still further improves the uniformity of the distribution of the lime powder and oxygen while retaining the lamina flow pattern characteristic of the gaseous stream upon passage through the tuyere which enables the stream to become detached from the walls of the inlet of the tuyere with less wear of the latter. Moreover, the variable length of the connecting pipes enables the number of tuyeres to be increased by an appropriate arrangement.

Having now described our invention what We claim as new and desire to secure by Letters Patent is:

1. A device for injecting fluid and powdered products in a converter, comprising in combination tuyeres having a first inside diameter and located adjacent a bottom of the converter, a cylindrical manifold for the fluids and powdered products disposed in a centre part of and under the bottom of the converter, connecting pipes having a second inside diameter larger than said first inside diameter and extending radially outwardly from the manifold, the connecting pipes having the shape of a lyre with a substantially complete loop, a connector defining a frustoconical bore having at one end said first diameter and at an opposite end said second diameter interconnecting each tuyere to a corresponding one of said connecting pipes, the frustoconical bore having such taper as to detach the stream of fluid and powdered products from the inner surface of the tuyere adjacent the connector and thereby reduce wear of said inner surface and permit the avoidance of inner protecting tubes for the tuyere.

2. A device as claimed in claim 1, wherein the cylindrical manifold comprises a partition wall dividing the manifold into an upper stage and a lower stage and means defining a cylindrical neck in the partition wall which puts the two stages in communication with each other, the connecting pipes being connected to the upper stage, and a supply conduit which is connected to the lower stage of the manifold supplying the fluids and powdered products tangentially of the manifold.

3. A device as claimed in claim 1, further comprising a second cylindrical manifold for a fluid for cooling a nose of the tuyeres disposed below the manifold for the fluid and powdered products, T-couplings each located at and surrounding an inlet portion of each tuyere and supplying an annular stream of cooling fluid around the tuyere, and S-shaped connecting pipes extending radially from the second manifold in planes containing the tuyeres and connecting the second manifold to the T-couplings.

4. A device as claimed in claim 1, wherein rectilinear portions of the connecting pipes between the manifold and the tuyeres are of unequal lengths.

5. A device as claimed in claim 4, wherein the manifold is in a central position slightly offset with respect to the centre of the bottom of the converter.

6. A device as claimed in claim 4, further comprising a second cylindrical manifold for a fluid for cooling a nose of the tuyeres disposed below the fluid and powdered product manifold, T-couplings each placed at an inlet of each tuyere, and extended lyre-shaped connecting pipes having an open loop connecting the second manifold to the T-couplings.

7. A device as claimed in claim 6, wherein the connecting pipes extending from the second manifold are located below pipes extending from the fluid and powdered product manifold and substantially on the same axis.

8. A device as claimed in claim 6, wherein the supply conduits for the two manifolds are substantially orthogonal to each other.

9. A device as claimed in claim 8, wherein the flattened contour is a curvilinear trapezium.

10. A device as claimed in claim 8, wherein the flattened contour is an ellipse.

11. A device as claimed in claim 6, wherein the supply conduits of the two manifolds are substantially parallel to each other and disposed substantially symmetrically with respect to the centre of the manifolds.

12. A device as claimed in claim 4, wherein the tuyeres are arranged on a flattened contour which is substantially centered on the centre of the bottom of the converter.

* * * * *